US005520471A

United States Patent [19]

Leys et al.

[11] Patent Number: 5,520,471

[45] Date of Patent: May 28, 1996

[54] THERMAL IMAGE-RECORDING APPARATUS WITH LOCKING MEANS FOR HOLDING A PRINT HEAD

[75] Inventors: Paul Leys, Kontich; Bernard Schollaert, Zellik, both of Belgium

[73] Assignee: AGFA-Gevaert N.V., Mortsel, Belgium

[21] Appl. No.: 161,314

[22] Filed: Dec. 2, 1993

[30] Foreign Application Priority Data

Dec. 14, 1992 [EP] European Pat. Off. ..... 92203896

[51] Int. Cl.[6] ..... B41J 2/32

[52] U.S. Cl. ..... 400/120.16; 347/197

[58] Field of Search ..... 347/197, 198; 400/120.16, 120.17, 692

[56] References Cited

U.S. PATENT DOCUMENTS

| | | | |
|---|---|---|---|
| 3,960,255 | 6/1976 | Bisson et al. | 400/120.16 |
| 4,055,743 | 10/1977 | Conta et al. | 347/197 |
| 4,350,448 | 9/1982 | Hanagata et al. | 400/120.16 |
| 5,245,356 | 9/1993 | Ota et al. | 347/197 |

FOREIGN PATENT DOCUMENTS

| | | | |
|---|---|---|---|
| 1-221258 | 9/1989 | Japan | 347/197 |
| 5-169764 | 7/1993 | Japan | 347/197 |

*Primary Examiner*—David A. Wiecking
*Attorney, Agent, or Firm*—William J. Daniel

[57] ABSTRACT

A thermal image recording apparatus has a thermal print head removably supported on a supporting wall and held in place by a releasable latch arrangement which can take the form of at least one movable detent engageable with a rib provided for that purpose on the print head, e.g. on a cooling fin on the rear side of the print head. The detent can be a lever arm having at one end a hook for engaging the rib, the arm being pivotable to dis-engage the hook from the rib and release the print head for removal. The arm is preferably spring-biased to normally engage the rib and both rib and hook can have inclined surfaces allowing for snap-engagement thereof when the print head is mounted on the supporting wall. Preferably, a rib and associated detent is provided at opposite ends of the print head. Alternatively, the latch can be rotated in a plane parallel to the supporting wall to and from a latching position engaging the rib to release position disengaged therefrom. Either kind of latch can be connected to an actuating lever accessible from the exterior of the apparatus.

10 Claims, 7 Drawing Sheets

THERMAL IMAGE-RECORDING APPARATUS WITH LOCKING MEANS FOR HOLDING A PRINT HEAD

BACKGROUND OF THE INVENTION

1. Field of the Invention

The present invention relates to a thermal image recording apparatus which comprises a thermal print head provided with a heat sink.

2. Description of the Prior Art

In the thermal printing process, a dye-bearing donor ribbon is brought into contact with a dye-receiving print sheet at a print zone. Thermal printing is effected by contacting the donor ribbon with a multi-element print head which spans the ribbon in a direction transverse to the direction of ribbon travel. The print head typically comprises a linear array of closely spaced resistive heating elements, each being independently addressable by an applied voltage to heat that portion of the donor ribbon directly opposite and thereby cause dye to transfer from the donor ribbon to the print sheet. To maintain intimate contact between the donor ribbon and print sheet during this printing operation, the donor ribbon and print sheet are partially wrapped over the surface of a rotatably driven print drum.

The amount of picture element formation on the print sheet depends on the temperature of the heating elements, and on the temperature of the print head itself. The electric energy applied to the heating elements is controlled within a prescribed range by a control circuit. The temperature of the print head itself, on the other hand, is kept under control by dissipating the heat accumulated during printing by means of a heat sink. To that end, a stream of cooling air produced by a blower is directed over the fins of the heat sink.

The lifetime of a print head of the described type is limited since the rubbing contact of the backside of the dye donor ribbon with the resistive heating elements during each printing cycle causes accelerated wear of the heating elements. Typically, a print head is suited for performing 15,000 to 60,000 printing operations on an A4 cm format. For colour printing where usually patches of cyan, yellow and magenta dyes are printed in repeating series, this means that after approximately 5,000 to 20,000 prints the print head needs to be replaced.

Known print heads are mounted in the apparatus by means of a plurality of screws requiring quite some skill from the operator in order to perform the operations of holding the print head and mounting the screws simultaneously.

Furthermore, said screws must be tightened evenly in order to avoid torsion or bending of the printing head which can cause uneven pressure of the head on the dye-bearing donor ribbon in the print zone.

SUMMARY OF THE INVENTION

Object of the Invention

The present invention aims to provide a thermal image recording apparatus which comprises a print head, whose mounting is easy and can be done without risk by an unskilled operator, such as the user of the apparatus.

Statement of the Invention

In accordance with the present invention, a thermal image-recording apparatus which comprises an elongate print head with a thermal print circuit and a heat sink, ventilation means for cooling said sink, and a print drum for supporting a dye-receiving print sheet in front of said print head, is characterised in that said apparatus has supporting wall means onto which said print head is seated with its rearside, and springbiased locking means for holding the print head onto said wall means with a controlled pressure.

The term "print head" stands for the assembly of a thermal print circuit comprising a printed circuit board with a linear array of closely spaced resistive heating elements, electronic circuitry for supplying the image signals thereto and connectors for connecting the print circuit to the circuitry of the apparatus, and a heat sink. The thermal print circuit is in heat-conductive contact with the heat sink. In one way, the thermal print circuit may be screw-fitted to the heat sink, but often the thermal print head is fixedly attached to the sink by means of a heat-conductive resin, and thus the electronic and the cooling part constitute in fact one unit, called herein print head.

According to one embodiment of the invention, the locking means comprises one rib-like extension of a central cooling fin of the heat sink of the print head, and a co-operating detent in the housing of the apparatus, which is displaceable in a direction parallel to the print head. Suitably, said detent is mounted on a rod which is axially displaceable and is biased by spring means to keep the detent engaged with the corresponding rib-like extension of the heat sink. According to a preferred embodiment, said detent and rib-like extension have co-operating slanting guide surfaces allowing their snap-fitting engagement upon mounting the print head.

According to another embodiment of the invention, the print head has rib-like extensions at both its lateral ends, and two latches rotatable in a plane parallel to that of the supporting wall means for engaging the corresponding rib-like extensions of the head, said latches being mounted on rotatable pins that carry springs for axially spring-biasing the latches in the rearward direction of the head. Said pins suitably have a lever for rotating them.

The print head preferably is provided with holes co-operating with register pins in the apparatus for determining the exact lateral position of the head.

BRIEF DESCRIPTION OF THE DRAWINGS

The invention will be described hereinafter by way of example with reference to the accompanying drawings wherein.

DETAILED DESCRIPTION OF THE INVENTION

Figure 1:
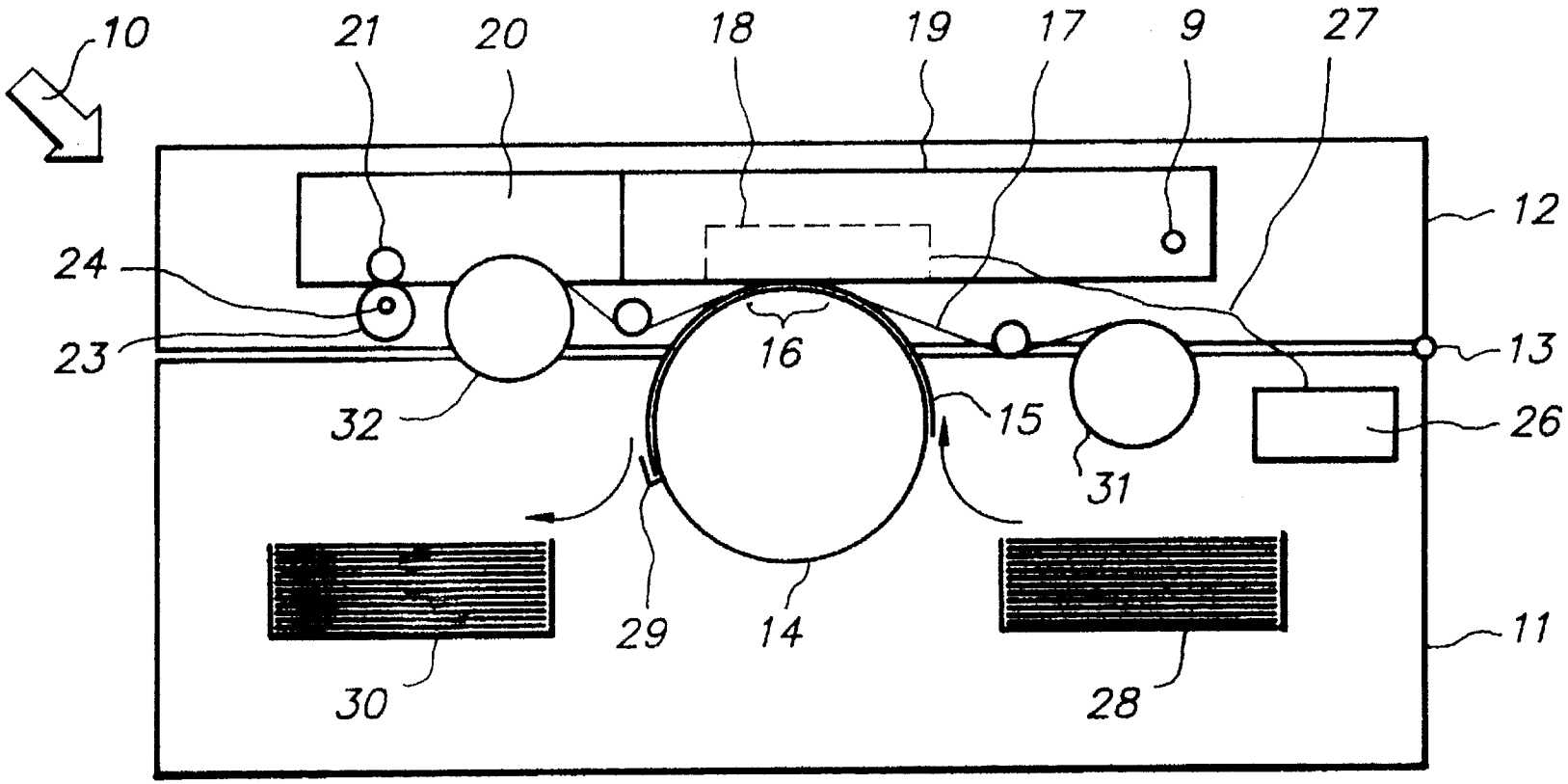
FIG. 1 is a diagrammatic representation of one embodiment of a thermal image-recording apparatus according to the present invention, the print head being in the operative position.

FIG. 1 shows a diagrammatic representation of one embodiment of a thermal image recording apparatus according to the present invention.

The apparatus is mounted in a housing 10 having a base 11 and a lid 12 hinged to the base at 13, and generally comprises a cylindrical print drum 14 which functions to support and transport a print receiver sheet 15 through a print zone 16 where it receives thermally printed information.

Thermal printing is effected by advancing a dye-bearing donor ribbon 17 through the print zone between the print-receiver sheet 15 and a print head 18.

Figure 2:
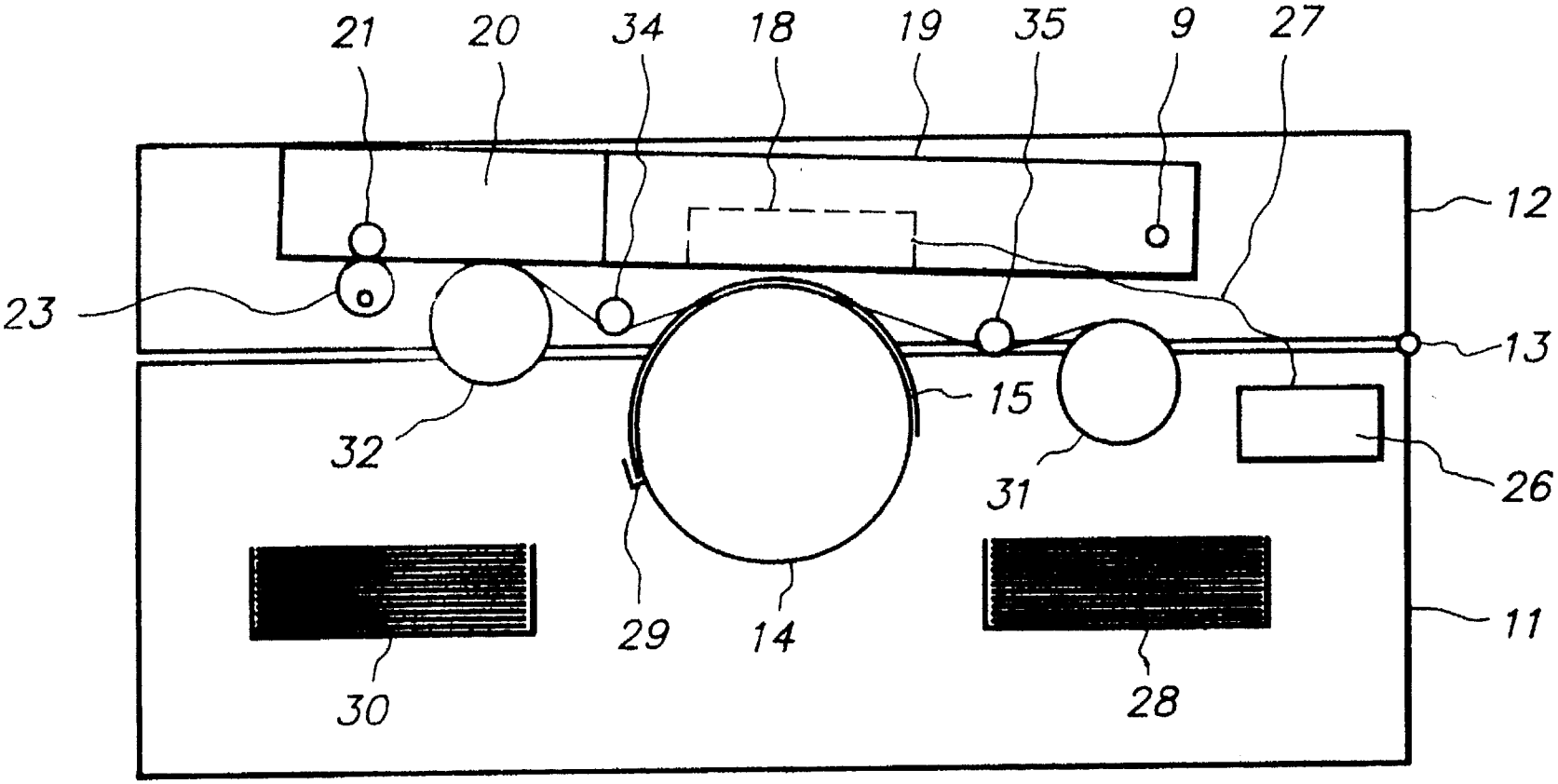
FIG. 2 shows the apparatus according to FIG. 1 with the print head in the inoperative position.

The print head is shown in broken lines and is mounted in a sub-housing 19 mounted in lid 12 pivotable about a pin 9. The sub-housing has two arms 20 spaced in parallel, which are interconnected by a rod 21. Rod 21 rests on a cam 23 mounted on shaft 24 equally mounted with its driving motor (not shown) in lid 12. Rotation of the cam brings the print head from its print position in which it presses against the print drum and the media therebetween (see FIG. 1), into a non-printing position in which the print head is spaced from the print drum (see FIG. 2).

Print head 18 spans the print drum and is of conventional design, comprising a linear array 25 (see FIG. 4) of closely spaced resistive elements, each being independently addressable with image information by an applied voltage provided by a microprocessor 26 connected via cable 27. As each resistive element is addressed, it heats that portion of the donor ribbon directly opposite, thereby causing dye to be transferred from the donor ribbon to the print receiver sheet. In colour thermal printers, the donor ribbon usually comprises patches of cyan, yellow and magenta dyes in a repeating series, and the print receiving sheet is rotated three times through the print zone to receive a full-colour image. The print receiver sheets are fed to the drum from a sheet supply 28 and are clamped to the drum by a suitable clamping mechanism 29. Upon receiving the thermal image, the clamping mechanism releases the print receiver sheet allowing it to enter an output tray 30 which has been illustrated within the housing but which may be located in front of the apparatus as well. Print drum 14 is rotatably driven by a precision stepper motor which in turn is controlled by microprocessor 26. The microprocessor also functions to control the position of the subhousing, via cam 23, so as to move print head 18 to its non-printing position to allow passage of the clamping mechanism through the print zone.

The dye-bearing donor ribbon 17 is fed from a supply spool 31 to a take-up spool 32 driven by a suitable motor. Both spools can be fitted in a disposable cassette for ease of handling, as known in the art.

Figure 3:
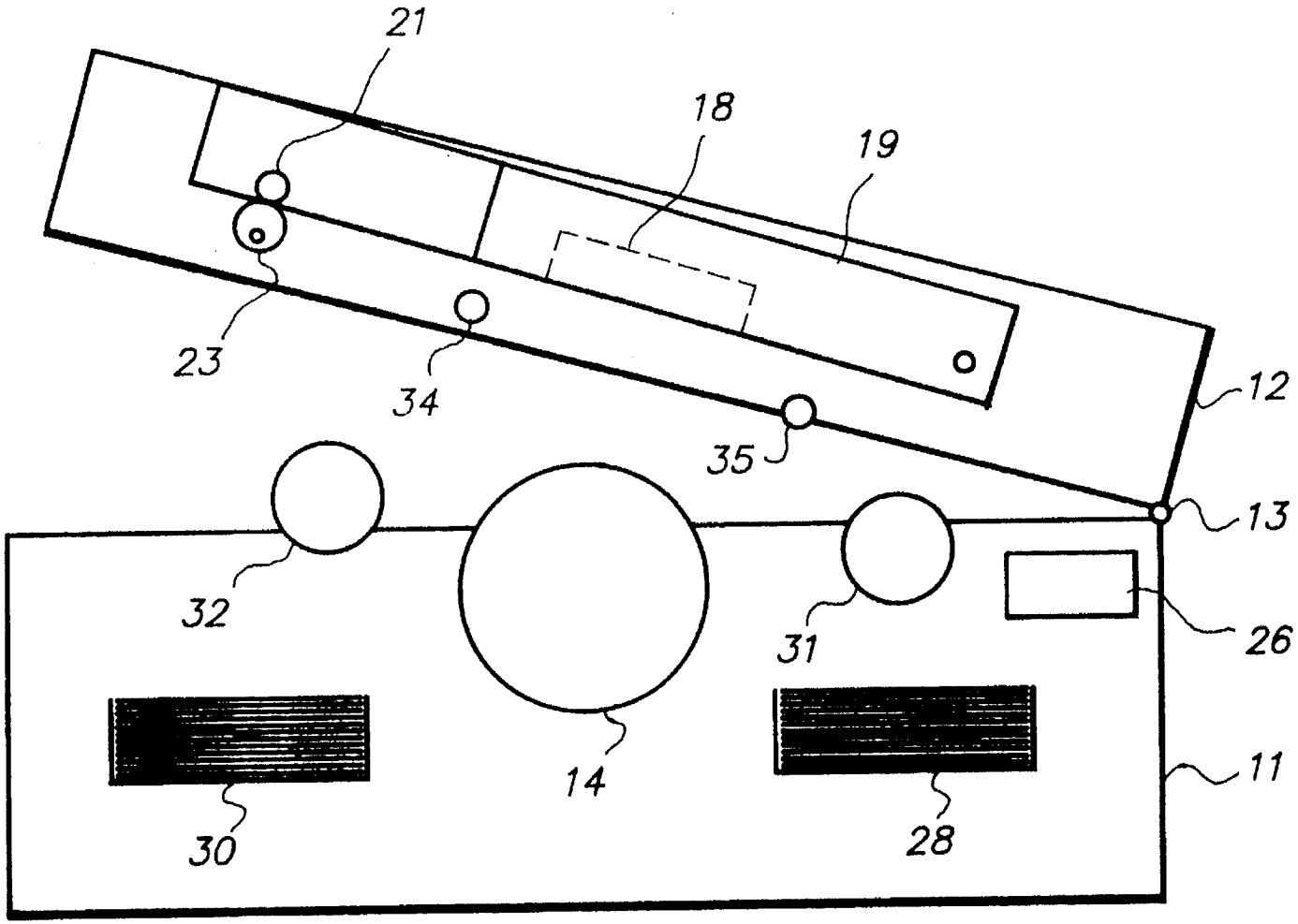
FIG. 3 shows the apparatus according to FIG. 1 with the lid opened.

FIG. 3 shows the apparatus with lid 12 opened, the print head being brought into its non-printing position by appropriate rotation of cam 23. This figure also shows that rollers 34 and 35 controlling the path of the dye-donor ribbon move together with lid 12.

Figure 4:
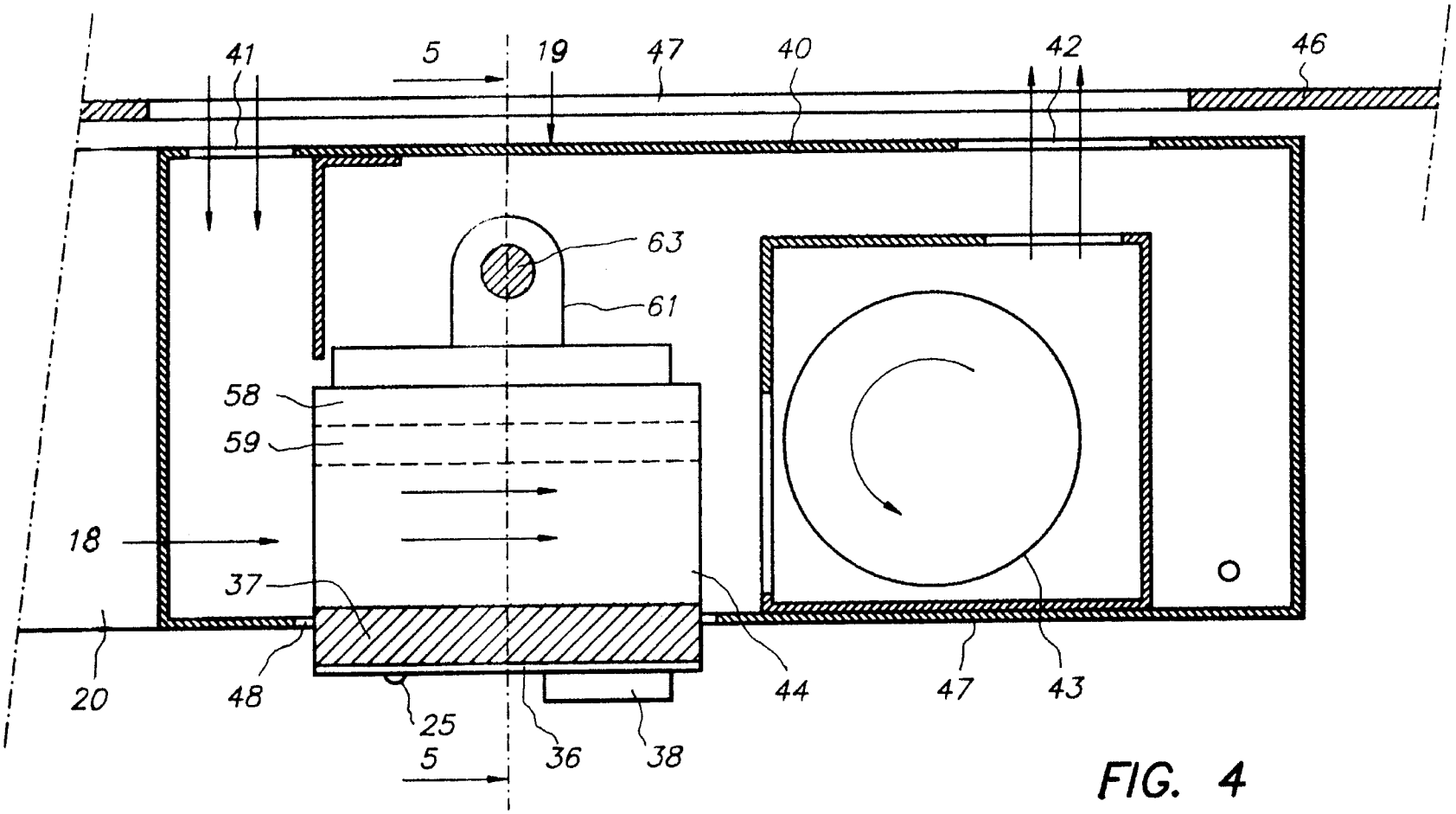
FIG. 4 is an enlarged cross-sectional view of the sub-housing of the apparatus according to FIG. 1.
Figure 5:
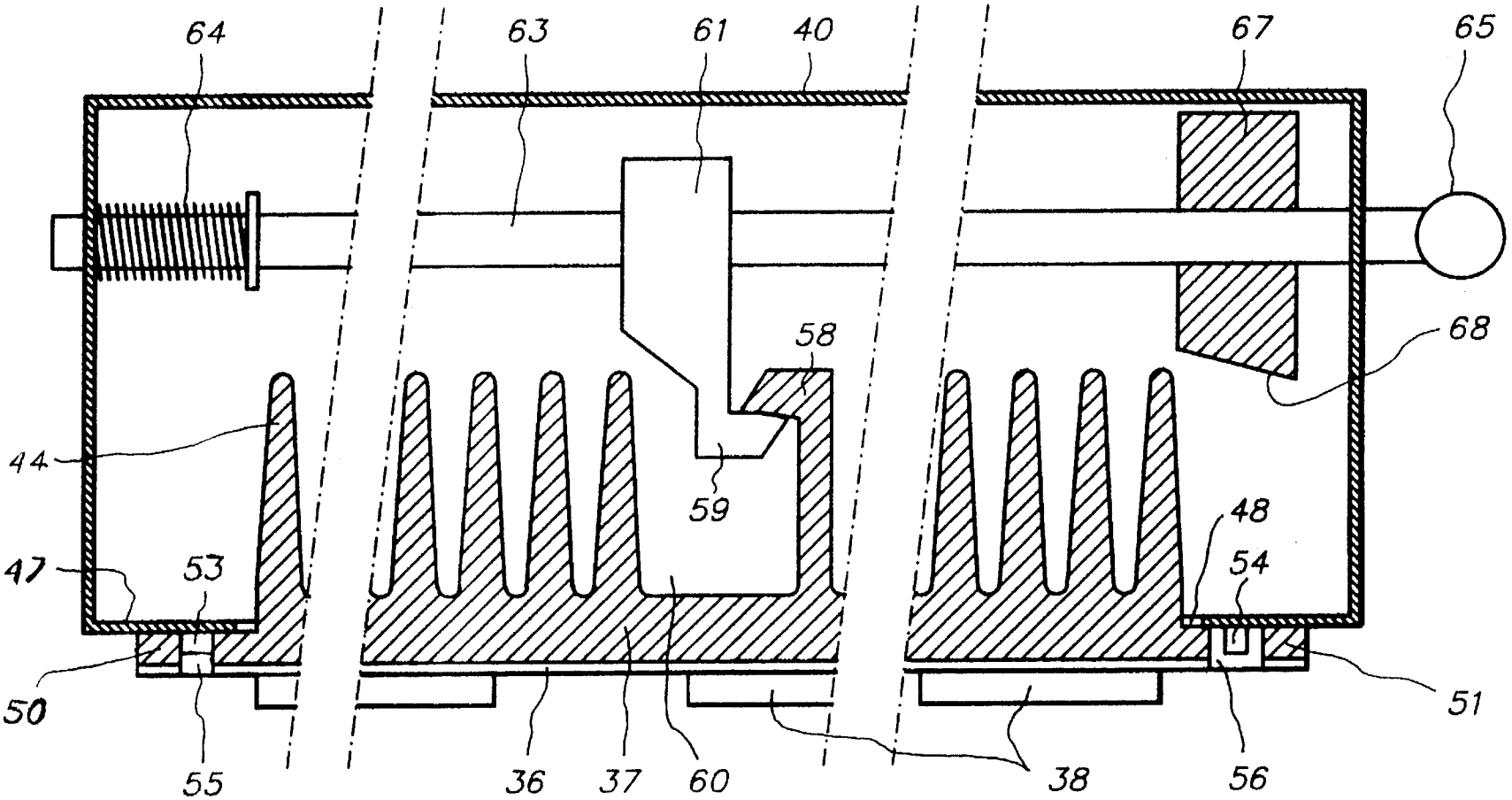
FIG. 5 is a longitudinal section of the printing head on line 5—5 of FIG. 4.

The mounting and the cooling of the print head are illustrated in detail in the enlarged views of FIGS. 4 and 5.

Referring to FIG. 4, the print head 18, which is mounted in sub-housing 19, is in fact an assembly of a thermal print circuit board 36 and a heat sink 37. Board 36 has a linear array 25 of heating elements, and a number of electronic components 38 comprising shift registers, buffers, etc., electric integrated connectors for electrically connecting the head to a flexible cable. The described connectors facilitate the replacement of the print head. Such replacement has to occur rather frequently in practice since the lifetime of thermal print heads of the described type is limited as mentioned already.

Sub-housing 19 has in its top wall 40 an elongate rectangular air intake opening 41 and a similar air exhaust opening 42.

Air drawn into the sub-housing by a common tangential-type blower 43 flows through the housing as indicated by the parallel arrows and evacuates heat from fins 44 of heat sink 37. Upper wall 46 of lid 12 of the apparatus has been partly shown in FIG. 4. This wall may have a large opening 47 covered by a perforated plate or the like, thereby assuring for the openings 41 and 42 free access to the environmental air.

The mounting of the print head in the sub-housing is as follows.

Bottom wall 47 of sub-housing 19 has a rectangular opening 48. This opening is slightly wider than the print head, whereas it is notably shorter than the head.

Referring to FIG. 5, heat sink 37 of the print head has two shoulders 50 and 51. The top surface of these shoulders is well straight so that they fit tightly against the corresponding section of the bottom wall 47 of the sub-housing. The portion of the heat sink comprised between said two shoulders extends through opening 48 inside the sub-housing.

The shoulders of the print head may have been obtained by cutting away portions of a standard-type heat sink and next machining the supporting surfaces, but the heat sink may as well have been integrally extruded to the required shape.

The exact lateral position of the print head on the bottom wall of the sub-housing is obtained via two register pins 53 and 54 extending from the bottom wall, and engaging a corresponding bore 55 in the shoulder of the head on one end, and a slotlike hole 56 at the opposite end.

More details about the advantages and the mounting of print head 18 in sub-housing 19 are set forth in our co-pending EP application no. 92/203894.8 entitled: "A thermal image-recording apparatus". The holding of the print head in the sub-housing is done in accordance with the present invention by means of co-operating detents 58 and 59. Detent 58 is in fact an integral portion of a fin 44 of heat sink 37 which is located close to an elongate central space 60 in the heat sink, and the length of which equals that of the fin.

Detent 59 is a hook-like extension of arm 61 which is fitted to a rod 63. Rod 63 is mounted for axial sliding movement through corresponding bores in opposite side walls of sub-housing 19, and is biased by compression spring 64 in the right-hand direction according to FIG. 5. A knob 65 allows to push the rod to the left.

Rod 63 is provided with a cam 67 having a flat top face ensuring a non-rotational movement of the rod by co-operation with top wall 40 of the sub-housing, and with a slanting cam surface 68 co-operating with the most right-hand side fin 44 to exert downward pressure on said fin thereby to facilitate the removal of the print head from the sub-housing.

Figure 6:
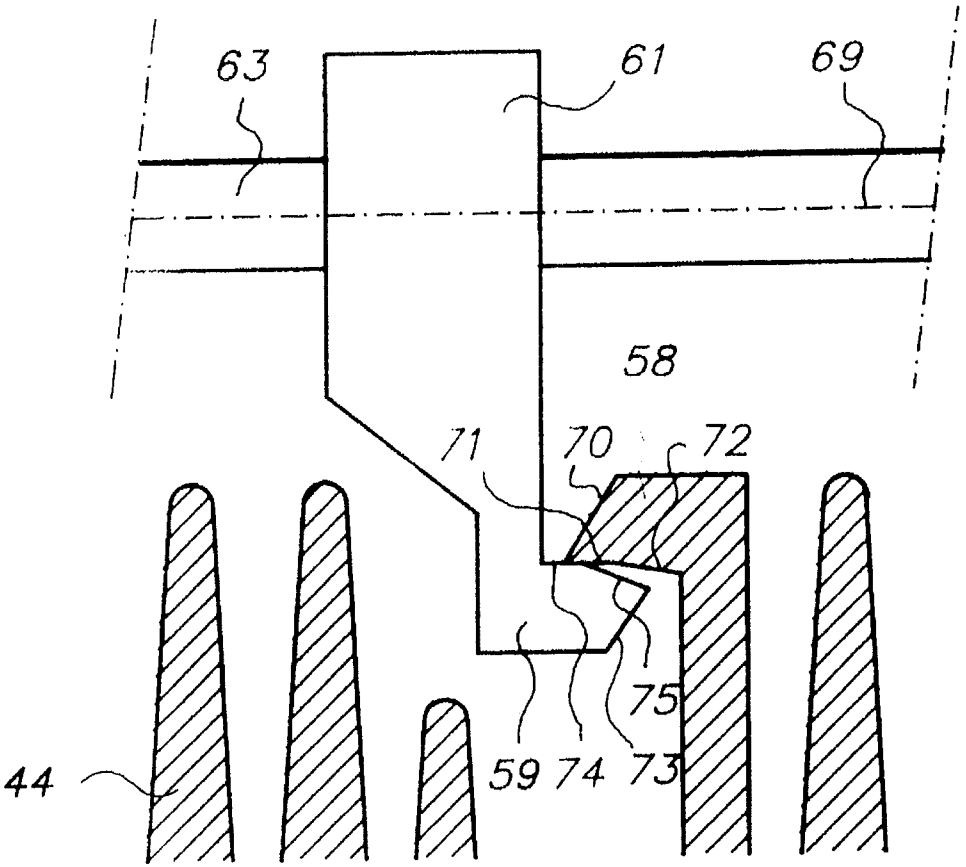
FIG. 6 is an enlarged view of the detent mechanism shown in FIG. 5.

FIG. 6 shows more details of detents 58 and 59. Detent 58 has a slanting guide face 70, a holding face 71 running horizontally, i.e. parallel to axis 69 of rod 63, and to the print head, and a slanting biasing face 72.

Detent 59 has a slanting guide face 73, a horizontal holding face 74 and a slanting biasing face 75.

The operations of mounting and demounting a print head are as follows. The operator takes the print head carefully in his hand and inserts the fins of the head through opening 48 of the sub-housing, it being understood that lid 12 is wider opened than illustrated in FIG. 3. The correct lateral position of the head is obtained by the registering of pins 53 and 54 with corresponding bores 55 and 56. During seeking for correct registering, face 73 of detent 59 has already entered in contact with corresponding face 70 of detent 58, and as the print head is pushed to firmly seat on wall 47, both detents snap fit into each other. The end position is as shown in FIG. 6, both parallel faces 71 and 74 engaging each other. This engagement prevents the detents from disengaging, e.g. if the the apparatus undergoes a severe shock, as by falling on a desk. However, movable detent 59 can advance further than shown in FIG. 6 and slanting faces 72 and 75 will engage each other, causing a biased clamping of the print head under the axial bias of rod 63. Finally, the operator inserts the plugs of the flexible connecting cables in connectors 38.

The print head is removed by pushing rod 63 inwardly by means of knob 65. Detent 59 is moved away from detent 58 and in that way sets free the head for being taken out. Cam 68 engages simultaneously the outermost fin 44 and urges thereby the head downwardly. This latter feature is welcome since as a consequence of heating of the print head, collection of dust, etc., the head can tend to stick to its mounting base. Progressive liberation of the head as described avoids that an inadvertent operator would start to pull on the head, or on its delicate components, in case the head would stick to the sub-housing.

Figure 7:
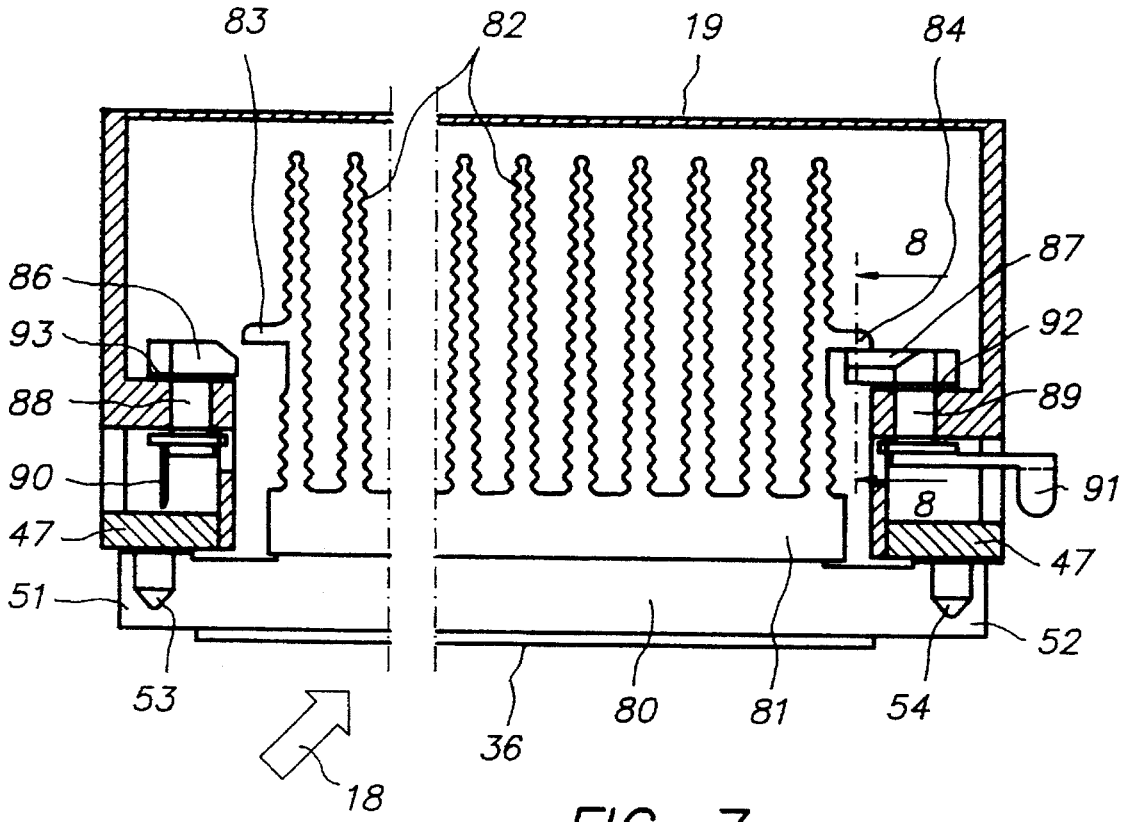
FIG. 7 is a longitudinal cross-section of the printing head showing a different locking mechanism.
Figure 8:
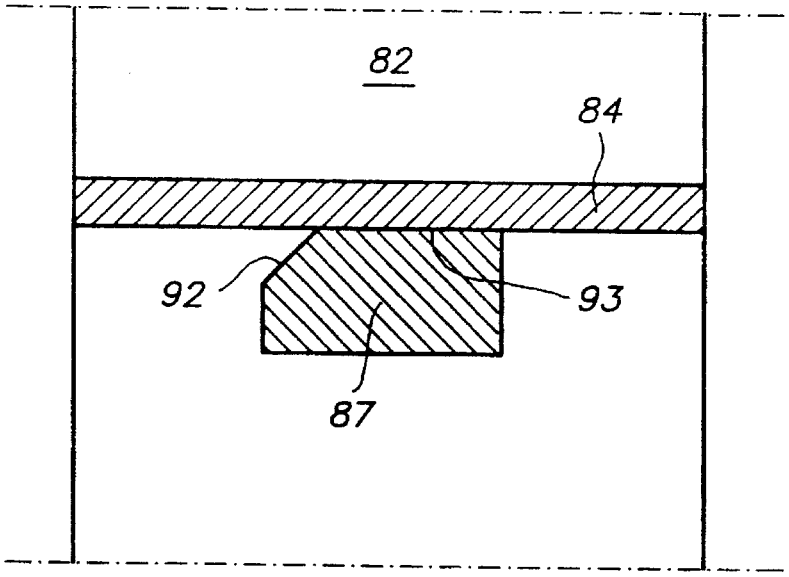
FIG. 8 is a section on line 8—8 of FIG. 7.

FIGS. 7 and 8 show a different embodiment of locking means for locking the print head in the sub-housing.

Referring to FIG. 7, print head 18 comprises a metal base 80 and a heat sink 81 fitted thereto. The head is seated with two shoulder portions 51, 52 on corresponding sections of bottom wall 47 of sub-housing 19. The exact lateral position of the print head in the sub-housing is obtained via register pins 53 and 54 as described hereinbefore. Heat sink 81 has a plurality of fins 82, the two outer fins being provided with ribs shown as 83 and 84. The heat sink can be a one piece component but can be assembled from different units as well. It is made by extrusion moulding, and so the width of ribs 83 and 84 equals the width of fins 82.

Sub-housing 19 is provided with two latches 86 and 87 fitted to pins 88 and 89 that are rotatable in inward extensions of corresponding walls of sub-housing 19. Pins 88 and 89 have levers 90 and 91 by means of which they can be pivoted over 90 degrees from an inoperative position as shown at the left-hand side of the figure, into a locking position as shown at the right-hand side. The levers are engageable by the operator's fingertip through an opening in the lateral wall of the sub-housing.

FIG. 8 is a section on line 8—8 of FIG. 7. Latch 87 has a slanting face 92 that permits the latch to slide under rib 84 as the latch is pivoted into its locking position while the printing head is held by hand into the sub-housing. Latch 87 also has a flat top face 93 which firmly engages the corresponding lower face of rib 84. This top face causes an upward pressure on rib 84, and thus on the head, under the bias of spring 92, which suitably is a spring disc, e.g. of the type Belleville disc. This upward pressure causes lateral end 52 of the head to be firmly seated on the corresponding portion of bottom wall 47 of housing 19. The same clamping force occurs at the opposite side of the head where spring 93 causes latch 86 (in its closed position) to engage rib 83.

The invention is not limited to the embodiments described hereinbefore.

The print head need not necessarily be mounted in a sub-housing for its cooling as described, but may as well be mounted freely in the main housing of the apparatus.

The print head can have at its rearside three shoulders or supporting points, thereby to ensure a three-points support for the head.

The supply and take-up rolls for the dye-donor ribbon need not necessarily be provided in a disposable cassette, but can also be supported in a dedicated frame, which is loaded by the operator with dye-donor ribbon outside of the apparatus. Suchlike arrangement is disclosed in our copending EP application no. 92 203 247.9 entitled "A dye ribbon package for use with a thermal printer and a method of loading the reloadable cassette of a thermal printer with a dye ribbon from a dye ribbon package", filed on 22.10.92.

We claim:

1. A thermal image recording apparatus which comprises an elongated print head with a thermal print circuit on a front side and a heat sink on a rear side thereof, ventilation means for cooling said sink, and a print drum for supporting a dye-receiving print sheet (15) in front of said print head, supporting wall means on which the rear side of said print head is supported, and spring-biased locking means for holding the print head against said wall means with a controlled pressure.

2. A thermal image recording apparatus according to claim 1, which further comprises a housing around said heat sink and wherein said heat sink has at least one cooling fin and said locking means comprises at least one rib projecting from said cooling fin the heat sink, and cooperating latch means in said housing for latching engagement with said rib.

3. A thermal image recording apparatus according to claim 2, wherein said rib is located centrally of the print head.

4. A thermal image recording apparatus according to claim 3, wherein said latch means comprises a detent which is displaceable in a direction parallel to the length of the print head to disengage the same from the rib.

5. A thermal image recording apparatus according to claim 4, wherein said detent is mounted on a rod which is axially displaceable to release said detent from said rib and is biased by spring means (64) to keep the detent engaged with said rib.

6. A thermal image recording apparatus according to claim 5, wherein said print head is removable and remountable in said apparatus and said detent and said rib on said cooling fin have cooperating inclined guide surfaces allowing their snap-fitting engagement upon mounting the print head.

7. A thermal image recording apparatus according to claim 5, wherein said supporting wall means is generally planar and said locking means comprises a rib on a cooling fin of said heat sink at both the lateral ends of said print head and two latches each rotatable in a plane parallel to that of the supporting wall means to and from a latching position engaging the corresponding rib of the head to latch the head on said supporting wall means from and to an inoperative position disengaged from said rib, said latches being mounted on rotatable pins (88, 89) for rotation therewith, said pins extending perpendicular to the rotational plane of said latches and carrying springs for spring-biasing the latches in the axial direction of said pins rearwardly away from the front side of the head.

8. A thermal image recording apparatus according to claim 7, wherein each of said pins is adapted to be rotated by means of a lever connected thereto.

9. A thermal image recording apparatus according to claim 8, which further comprises a sub-housing within which said printing head is mounted, and said levers are accessible externally of said sub-housing for rotation of said latches.

10. A thermal image recording apparatus according to claim 9, wherein said sub-housing has openings therein through which said levers are accessible from the exterior of said sub-housing and when said latches are rotated to latching position by said levers, said levers are located inside said sub-housing.

* * * * *